US010151555B1

(12) United States Patent
Matson et al.

(10) Patent No.: US 10,151,555 B1
(45) Date of Patent: Dec. 11, 2018

(54) AIR CANNON WITH SABOT SYSTEM

(71) Applicant: Bell Helicopter Textron Inc., Fort Worth, TX (US)

(72) Inventors: Robert Wesley Matson, Bluff City, TN (US); David Kimble Huber, Piney Flats, TN (US)

(73) Assignee: Bell Helicopter Textron Inc., Fort Worth, TX (US)

( * ) Notice: Subject to any disclaimer, the term of this patent is extended or adjusted under 35 U.S.C. 154(b) by 0 days.

(21) Appl. No.: 15/617,889

(22) Filed: Jun. 8, 2017

(51) Int. Cl.
*F41B 11/62* (2013.01)
*F41F 1/00* (2006.01)
*F41B 11/73* (2013.01)

(52) U.S. Cl.
CPC ..... *F41B 11/73* (2013.01); *F41B 11/62* (2013.01)

(58) Field of Classification Search
CPC ... F41F 1/00; F41B 11/83; F41B 11/80; F41B 11/81; F41B 15/10; F42B 14/06; F42B 14/067; F42B 12/68
See application file for complete search history.

(56) References Cited

U.S. PATENT DOCUMENTS 1,469,883 A * 10/1923 Brakers ..... A01K 91/02 124/26
2,605,569 A * 8/1952 Kronhaus ..... A01K 91/02 124/27
3,536,054 A * 10/1970 Allcock ..... F41B 11/00 124/31
3,834,056 A * 9/1974 Filippi ..... A01K 91/02 43/19
4,040,198 A * 8/1977 Skibo ..... A01K 91/02 43/19
4,127,956 A * 12/1978 Hertkorn ..... A01K 91/02 43/19
4,678,143 A * 7/1987 Griffin ..... B64F 1/06 244/63
5,010,804 A * 4/1991 Lee ..... F41A 1/00 89/7
5,803,791 A * 9/1998 Chiles ..... A63H 37/00 124/1
6,354,182 B1 * 3/2002 Milanovich ..... F41F 3/04 124/17
6,662,701 B2 * 12/2003 Grosch ..... F41B 7/00 89/1.13
7,694,452 B2 * 4/2010 Croisetiere ..... A01K 91/02 124/56

(Continued)

FOREIGN PATENT DOCUMENTS

DE 3101929 A1 * 11/1982 ..... F41A 1/08

OTHER PUBLICATIONS

ASTM International, "Standard Test Method for Bird Impact Testing of Aerospace Transparent Enclosures", Designation: F330-16; West Conshohocken, PA; Nov. 17, 2016; 5 pages.

*Primary Examiner* — Derrick R Morgan
(74) *Attorney, Agent, or Firm* — Lightfoot & Alford PLLC

(57) ABSTRACT

An air cannon has a barrel and a sabot sized to fit within the barrel and configured to engage a projectile located within the barrel forward of the sabot. A flexible cord connects the sabot to a fixed location relative to the barrel. Forward motion of the sabot is decelerated by the cord after the sabot exits the forward end of the barrel, and the sabot is retained by the cord near the forward end of the barrel.

17 Claims, 4 Drawing Sheets

(56) References Cited

U.S. PATENT DOCUMENTS

| | | | | |
|---|---|---|---|---|
| 7,997,224 | B2 * | 8/2011 | Owen | F41F 3/10 114/238 |
| 9,016,267 | B1 * | 4/2015 | Tseng | F42B 10/14 124/71 |
| 9,074,844 | B2 * | 7/2015 | Essbaum | F41F 7/00 |
| 2004/0173197 | A1 * | 9/2004 | Moffitt | F41B 11/83 124/74 |
| 2007/0163558 | A1 * | 7/2007 | Riffe | F41B 3/005 124/22 |
| 2010/0252676 | A1 * | 10/2010 | Koessler | F41F 1/00 244/63 |
| 2011/0315817 | A1 * | 12/2011 | Miralles | B64C 39/024 244/63 |
| 2013/0239937 | A1 * | 9/2013 | Macri | B63C 9/22 124/56 |
| 2014/0221544 | A1 * | 8/2014 | Lichtenhan | C08L 23/12 524/403 |
| 2014/0224186 | A1 * | 8/2014 | Bianchi | A01K 15/02 119/719 |
| 2014/0318521 | A1 * | 10/2014 | Garofalo | F41B 11/73 124/61 |
| 2015/0008280 | A1 * | 1/2015 | Smoker | B63G 8/001 244/63 |
| 2016/0161230 | A1 * | 6/2016 | Vezain | F41A 21/16 89/1.816 |
| 2016/0290757 | A1 * | 10/2016 | Khoshnood | F41B 5/123 |
| 2016/0347476 | A1 * | 12/2016 | Andryukov | B64C 39/024 |

* cited by examiner

AIR CANNON WITH SABOT SYSTEM

BACKGROUND

Impact testing is often conducted for aircraft components to test for the amount of damage caused by events, such as bird strikes, that are expected to occur during aircraft operation. For bird-strike testing of, for example, aircraft transparencies (such as the windscreen of a helicopter canopy), fuselages, or blades, an air cannon may be used to launch a bird carcass or a gelatin substitute at a selected velocity.

When firing a semi-solid projectile from an air cannon during high-speed impact testing, the projectile, although it has a diameter similar to the ID of the barrel, does not create a solid seal because of its semi-solid characteristics. This leads to the use of sabots to drive the projectile forward within the barrel, thereby forming a more reliable and repeatable seal and minimizing the deformation of the projectile as it is accelerated during firing. Such a system is shown and described in ASTM Standard F330-16, titled "Standard Test Method for Bird Impact Testing of Aerospace Transparent Enclosures."

FIGS. 1 and 2 illustrate components of a prior-art air cannon. Air cannon 11 comprises an air tank 13, which is connected to a pressurized air source by line 15, and a cylindrical barrel 17 having a bore 19. A cylindrical sabot 21 with a forward pocket 22 is configured for being propelled forward through barrel 17 and away from tank 13 by the air pressure in tank 13, sabot 21 having an outer diameter smaller than the diameter of bore 19. After sabot 21 exits barrel 17, a sabot stripper 23 attached to the forward end of barrel 17 stops the forward motion of sabot 21 and retains sabot 21 within stripper 23.

FIG. 2 is a cross-section view of stripper 23, which is attached to barrel 17 adjacent muzzle 25. Stripper 23 comprises a body 27 formed from perpendicular plates 28. A conical cavity 29 within body 27 is truncated at the forward end by a bore 31. The rear diameter of cavity 29 is larger than bore 19 of barrel 17, allowing sabot 21 to pass into cavity 29, but the diameter of bore 31 is smaller than the outer diameter of sabot 21. The forward end of sabot 21 strikes the inside of cavity 29 at approximately the line indicated by numeral 33, and sabot 21 is retained within cavity 29 as projectile continues forward and exits stripper 23 through bore 31.

Current sabots are fired together with the projectile and either separate during flight or are caught at the end of the barrel with the sabot stripper. Both types of sabots are typically too damaged to be reused or not capable of multiple shots without major repairs. Also, cannons using sabot strippers require the sabot to be significantly larger than the projectile to ensure that the sabot is caught by the sabot stripper. This means that the barrel is larger than needed to house the projectile, adding unnecessary weight and size to the system. Also, the barrel may require reinforcement to accommodate the forces generated when catching a sabot at full velocity (>140 kn).

Alternative versions of sabots deform or break apart in flight, such as expanding cup, base, spindle, and ring sabots. However, in order to maintain the level of accuracy needed for impact testing in aviation (typically required to be within 1" of the target), projectiles are fired from a minimum required distance, and this is often approximately 5 feet from the target. This distance between the end of the barrel and the target is too short for a sabot to reliably come apart and clear the target during flight.

DETAILED DESCRIPTION

Figure 1:
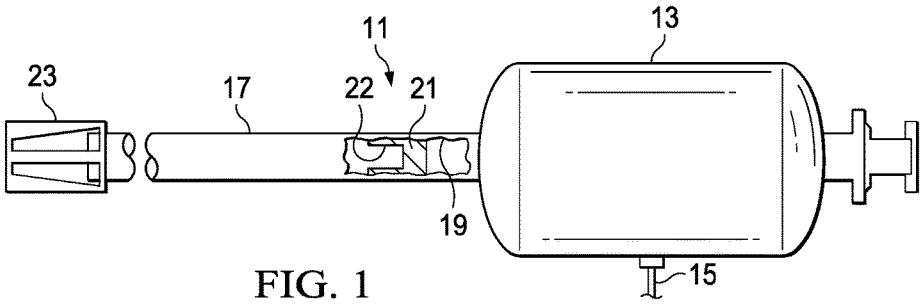
FIG. 1 (PRIOR ART)
FIG. 1 is a side view of prior-art air cannon, a portion of the cannon being shown in cross-section.
Figure 2:
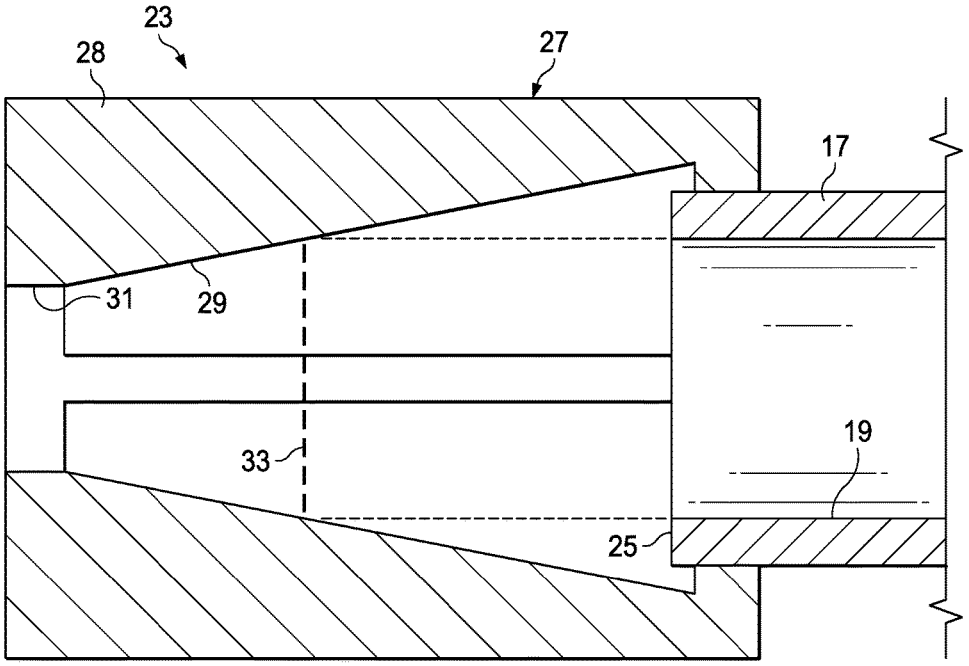
FIG. 2 (PRIOR ART)
FIG. 2 is a cross-section view of a portion of the prior-art cannon of FIG. 1.
Figure 3:
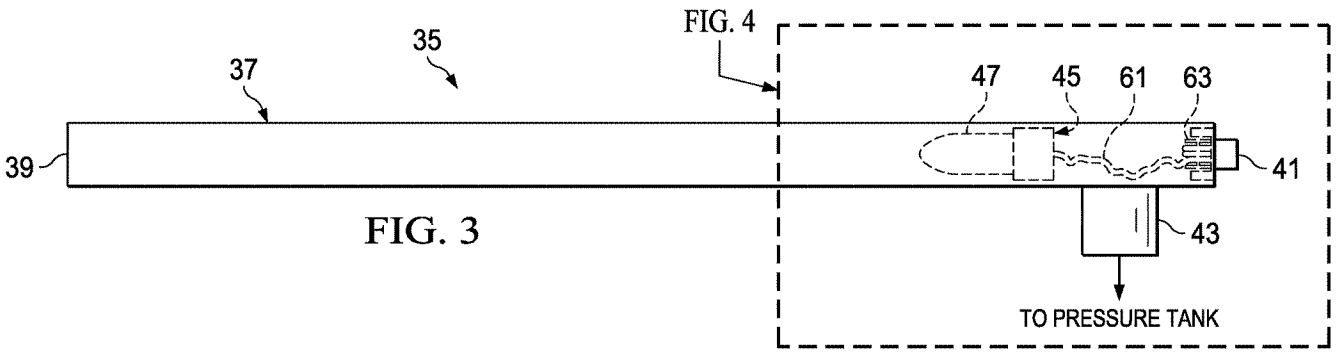
FIG. 3 is a side view of an air cannon with a sabot according to this disclosure.

In this disclosure, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

This disclosure divulges an air cannon having a sabot system that retains the sabot near the muzzle after firing and eliminates the need for a sabot stripper. This allows for using a sabot with an outer diameter that is approximately the same size as the projectile and for firing the cannon at minimum distances from the target. This sabot is not damaged during use, allowing the sabot to be reused for multiple shots.

FIGS. 3 through 8 illustrate an embodiment of an air cannon and sabot system according to this disclosure.

Air cannon 35 comprises a cylindrical, smooth-bore barrel 37 having a muzzle 39 at a forward end and a removable breech plug 41 installed at a rear end. Breech plug 41 is attached to a rear end of barrel 37 in any manner that permits breech plug 41 to be easily installed and removed from barrel 37. This configuration permits breech loading of barrel 37 from the rear, though barrel 37 may alternatively be loaded through muzzle 39. A pipe 43 is in fluid communication with barrel 37 and is connected to a pressurized air source (not shown) for providing air pressure during operation of cannon 35.

Figure 4:
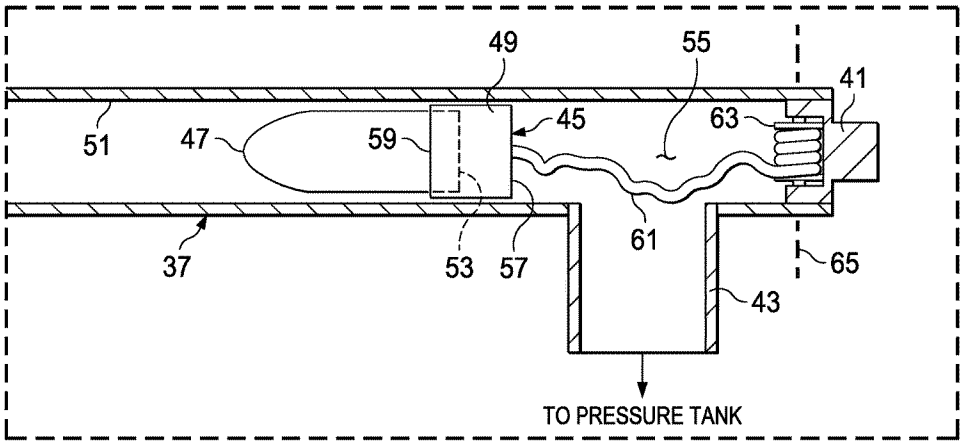
FIG. 4 is a side cross-section view of a portion of the cannon of FIG. 3.
Figure 5:
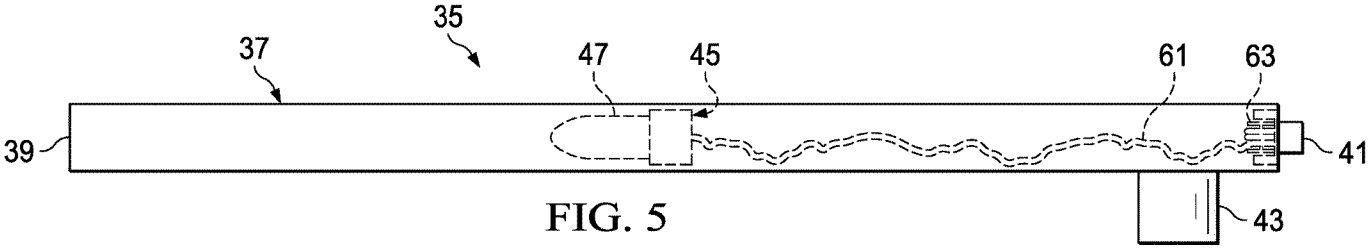
FIG. 5 is a side view of the cannon of FIG. 3 during operation.
Figure 6:
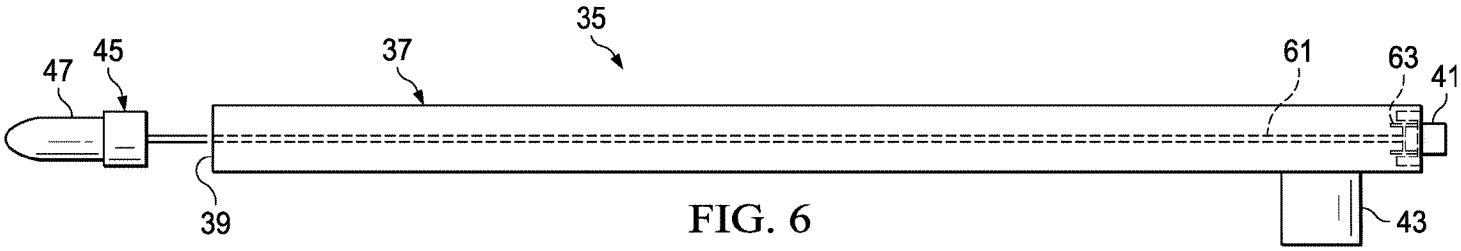
FIG. 6 is a side view of the cannon of FIG. 3 during operation.
Figure 7:
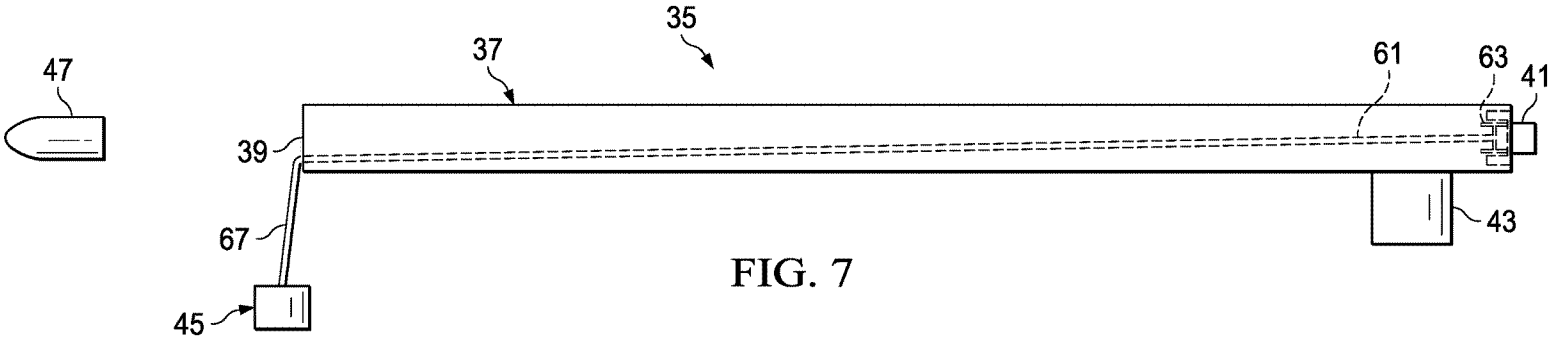
FIG. 7 is a side view of the cannon of FIG. 3 during operation.
Figure 8:
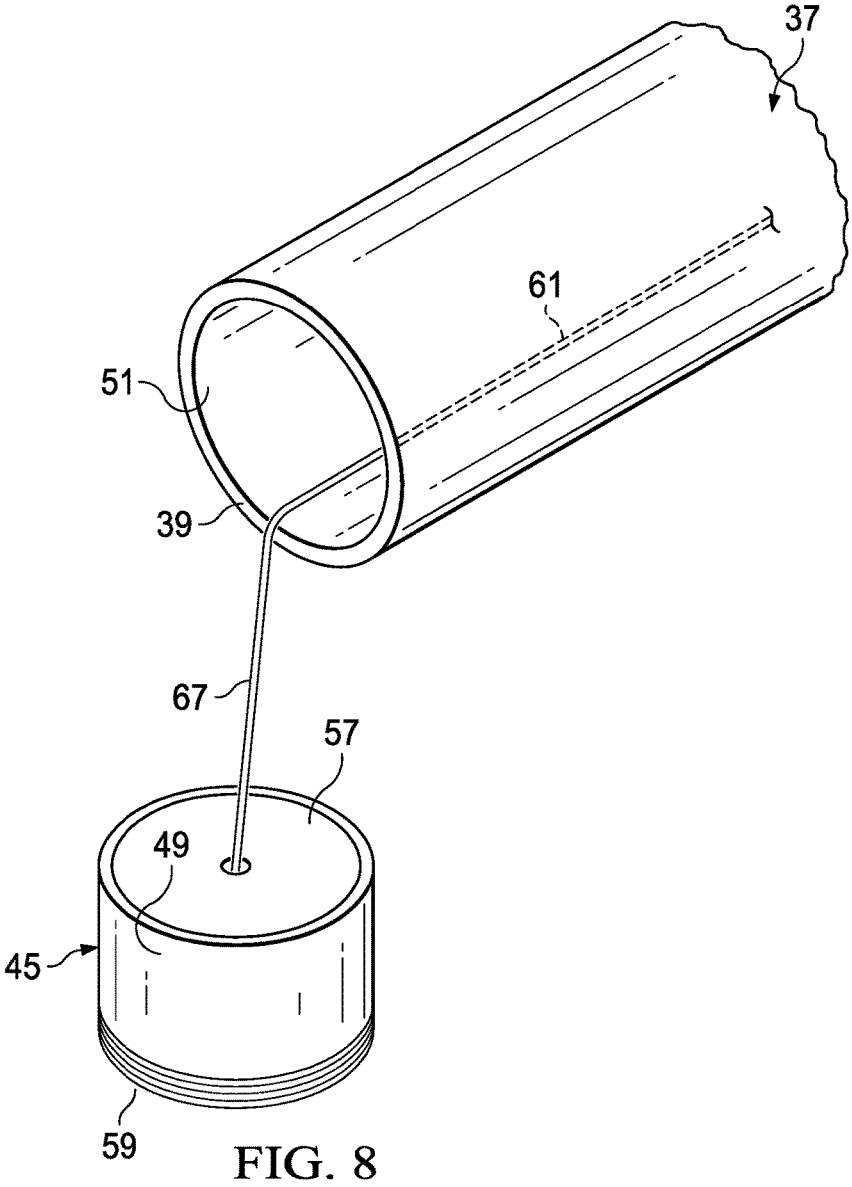
FIG. 8 is an oblique view of a portion of the cannon of FIG. 3.

As shown in the figures and in detail in the cross-section view of FIG. 4, air cannon 35 is configured to use a sabot 45 to launch a projectile 47. Sabot 45 is preferably formed from wood, such as balsa, or another strong, lightweight material, such as a composite material, that will not damage barrel 37 through contact during operation of cannon 35. Sabot 45 preferably has a weight less than 4 oz. Projectile 47 is preferably formed from a gelatin, such as a ballistic gelatin, or projectile 47 may be a bird carcass, such as that of a chicken. Sabot 45 is preferably a solid, unitary item and has an outer wall 49 having a selected diameter that is less than the diameter of a bore 51 of barrel 37 and approximately the same as the outer diameter (or, if not cylindrical, the cross-sectional dimensions) of projectile 47. A cup 53 is preferably formed in a forward face of sabot 45 to allow a rear portion of projectile 47 to be inserted therein. As shown, the diameter of bore 51 is approximately 4 in, though bore 51 may be larger or smaller to accommodate projectiles having another size. Sabot 45 may optionally have felt or a similar low-friction material installed on outer wall 49 to ensure minimal friction is caused by contact with bore 51 and to provide a seal to minimize bypassing gas.

Sabot 45 is driven forward in barrel 37 by pressurized air communicated through pipe 43 and accumulated in a chamber 55, which is formed between a rear face 57 of sabot 45 and breech plug 41. A forward face 59 of sabot 45 is configured to engage a rear portion of projectile 47, and the pressurized air in chamber 55 acts on rear face 57 to force sabot 45 and projectile 47 forward together toward and through muzzle 39 for launching projectile 47 toward a target. Forward face 59 preferably has a cup shape for engaging projectile 47, though face 59 may be flat or have another shape. Sabot 45 has a length sufficient to minimize yawing of sabot 45 within barrel 37, and the preferred minimum ratio of length to diameter is 0.75.

If air cannon 35 is used to fire projectile 47 without sabot 45, upsetting (deformation) of the rear end of projectile 47 causes obturation of barrel 37 and an undesirable amount of friction between projectile 47 and bore 51. As with gas checks used on bullets, sabot 45 provides for the necessary obturation without the upsetting of the material at the rear of projectile 47. Preliminary testing of cannon 35 has shown that the use of sabot 45 provides a 5-8% muzzle velocity increase for the same air pressure, which means that cannon 35 can generate the required muzzle velocity for impact tests using less air pressure.

To allow air cannon 35 to be operated without a sabot stripper and in close proximity to a target, a sabot system utilizes a cord 61 to limit the forward travel of sabot 45 relative to barrel 37. Cord 61 is preferably attached at one end to rear face 57 of sabot 45 and preferably attached at the other end to a fixed location relative to barrel 37. In the sabot system shown, a rear end of cord 61 is attached to a spool 63 that is rotatable relative to barrel 37 about an axis 65 perpendicular to the longitudinal axis of barrel 37. When using spool 63, cord 61 is wound onto spool 63 before firing, and forward motion of sabot 45 through barrel 37 causes cord 61 to unwind from spool 63 by rotating spool 63 about axis 65.

It should be noted that alternative fixed locations for attachment of cord 61 may be used. For example, cord 61 may be attached to breech plug 41 or to a boss (not shown) formed or installed within a rear portion of barrel 37, though the latter configuration might interfere with loading sabot 45 and projectile 47 from the rear of barrel 37. Also, cord 61 may alternatively be coiled behind sabot 45 or wound onto a fixed spool that allows for cord 61 to be pulled from the fixed spool during firing.

Cord 61 is preferably formed from a strong, flexible, and resilient material (such as, for example, nylon parachute cord) that can withstand the force exerted on cord 61 as sabot 45 is decelerated when reaching the maximum length of cord 61. This maximum length is selected to allow sabot 45 to exit muzzle 39 while driving projectile 47 and then to be suspended by a portion 67 of cord 61 outside of barrel 37. The length of cord 61 requires cord 61 to be coiled, folded, or otherwise collected rearward of sabot 45 prior to firing of cannon 35. Cord 61 may alternatively be formed from a highly elastic material, though any tension formed in cord 61 prior to exit of sabot 45 from barrel 37 will oppose the acceleration of projectile 47 and must be accounted for to achieve the desired test velocity.

Breech loading of air cannon 35 is accomplished by removing breech plug 41 from the rear end of barrel 37 and inserting projectile 47. In the firing position, projectile 47 is located forward of pipe 43. After projectile 47 is loaded into barrel 37, sabot 45 is placed behind projectile 47 with rear face 57 facing toward breech plug 41. If cord 61 is unattached at either end, one end of cord 61 is attached to rear face 57 of sabot 45 (preferably prior to insertion of sabot 45), and the other end is attached to spool 63 and wound onto spool 63 before installing breech plug 41 in the rear end of barrel 37.

During firing of air cannon 35, air is released from the pressure tank and through pipe 43 to chamber 55. The pressurized air then propels sabot 45 and projectile 47 forward within barrel 37, accelerating sabot 45 and projectile 47 together to a selected velocity as they exit muzzle 39. Sabot 45 is propelled forward in barrel 37, and cord 61 is unwound from spool 63 as spool 63 rotates on axis 65. As sabot 45 exits barrel 37, cord 61 becomes taut, decelerating sabot 45 and separating sabot 45 from projectile 47. Projectile 47 then travels toward the target, and sabot 45 is suspended near muzzle 39 on portion 67 of cord 61. To reset cannon 35 for another firing, breech plug 41 is removed from barrel 37, and cord 61 is freed from attachment to spool 63, plug 41, or barrel 37. Sabot 45 and cord 61 can then be removed from barrel 37, and the breech loading process can be repeated as described above.

Alternatively, air cannon 35 may be muzzle loaded, with sabot 45 and then projectile 47 being inserted into barrel 37 through muzzle 39. During muzzle loading, the end of cord 61 is preferably already attached to breech plug 41 or barrel 37.

It should be noted that barrel shapes other than cylindrical may be used, and some or all of the associated components may have the same shape as that of the barrel or have alternative shapes.

Also, it should be noted that a sabot according to this disclosure can be used in applications other than impact testing. For example, T-shirt cannons use compressed air to launch the shirts. If no sabot is used, the distances traveled by the shirts can vary significantly based on the seal the shirt creates within the barrel. A T-shirt cannon utilizing a sabot according to this disclosure would allow the cannon to have consistent results while preventing additional projectiles from leaving the cannon and potentially injuring a person toward whom the T-shirt is fired. Muzzle loading of such a cannon might allow for more rapidly repeated shots.

At least one embodiment is disclosed, and variations, combinations, and/or modifications of the embodiment(s) and/or features of the embodiment(s) made by a person having ordinary skill in the art are within the scope of this disclosure. Alternative embodiments that result from combining, integrating, and/or omitting features of the embodiment(s) are also within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. An air cannon system for impact testing of a target, comprising:

a generally horizontal barrel having a forward end and a rear end;

a source of pressurized air in fluid communication with the rear end;

a semi-solid projectile located within the barrel;

a sabot sized to fit within the barrel and configured to engage the projectile at a forward face of the sabot;

a cord having a selected length and connecting the sabot to a fixed location relative to the barrel; and a target located forward of the barrel;

wherein the barrel is aimed for firing the projectile toward the target and striking the target with the projectile; and wherein forward motion of the sabot when fired is decelerated by the cord after the sabot exits the forward end of the barrel, the length of the cord being selected to stop the forward motion of the sabot before the sabot strikes the target.

2. The air cannon system of claim 1, further comprising:

a removable breech plug configured to be installed at the rear end of the barrel.

3. The air cannon system of claim 1, further comprising:

a removable breech plug configured to be installed at the rear end of the barrel;

wherein the fixed location is on the breech plug.

4. The air cannon system of claim 1, wherein the cord is formed from a resilient material.

5. The air cannon system of claim 1, wherein the forward face has a cup shape.

6. The air cannon system of claim 1, further comprising:

a low-friction material installed on an outer wall of the sabot.

7. The air cannon system of claim 1, further comprising:

a spool configured to allow the cord to be wound onto the spool and then unwound from the spool during forward motion of the sabot.

8. The air cannon system of claim 1, further comprising:

a spool rotatable relative to the barrel, the spool being configured to allow the cord to be wound onto the spool and then unwound from the spool by rotating the spool during forward motion of the sabot.

9. A method of impact testing a target, the method comprising:

(a) connecting one end of a cord to a sabot;

(b) connecting the other end of the cord to a fixed location relative to a barrel of an air cannon, the barrel being generally horizontal and aimed toward a target located forward of the barrel;

(c) loading a semi-solid projectile in the barrel forward of the sabot;

(d) using compressed air to drive the sabot forward through the barrel until the sabot exits a forward end of the barrel; and (e) stopping forward motion of the sabot with the cord prior to the sabot striking the target.

10. The method of claim 9, wherein in step (b), the fixed location is a spool onto which the cord is wound prior to step (d).

11. The method of claim 9, wherein in step (b), the fixed location is a rotatable spool onto which the cord is wound prior to step (d).

12. An air cannon system for horizontal impact testing of a target, comprising:

a generally horizontal barrel having a forward end and a rear end;

a source of pressurized air in fluid communication with the rear end;

a semi-solid projectile located within the barrel;

a sabot located within the barrel and rearward of the projectile, the sabot engaging the projectile at a forward face of the sabot;

a cord connecting the sabot to a spool configured to allow the cord to be wound onto the spool and then unwound from the spool during forward motion of the sabot; and a target located forward of the barrel;

wherein the barrel is aimed for firing the projectile toward the target and striking the target with the projectile; and wherein forward motion of the sabot during firing is decelerated by the cord after the sabot exits the forward end of the barrel and before the sabot strikes the target.

13. The air cannon system of claim 12, further comprising:

a removable breech plug at the rear end of the barrel;

wherein the spool is coupled to the breech plug.

14. The air cannon system of claim 12, wherein the cord is formed from a resilient material.

15. The air cannon system of claim 12, wherein the forward face has a cup shape.

16. The air cannon system of claim 12, further comprising:

a low-friction material installed on an outer wall of the sabot.

17. The air cannon system of claim 12, wherein the spool is rotatable relative to the barrel.

* * * * *